United States Patent [19]

Clarke

[11] 4,175,727

[45] Nov. 27, 1979

[54] SINGLE FAILURE PROOF CRANE

[75] Inventor: Charles W. Clarke, Seattle, Wash.

[73] Assignee: Ederer Incorporated, Seattle, Wash.

[21] Appl. No.: 883,531

[22] Filed: Mar. 6, 1978

[51] Int. Cl.[2] ..... B66D 1/48

[52] U.S. Cl. ..... 254/173 R; 254/187.4; 192/12 R

[58] Field of Search ..... 254/173 R, 187.3, 187.4, 254/187.6, 186 R, 172; 192/12 R, 15, 18 R; 188/110

[56] References Cited

U.S. PATENT DOCUMENTS

| | | | |
|---|---|---|---|
| 2,017,352 | 10/1935 | Quick | 254/187.4 |
| 2,468,092 | 4/1949 | Mahnke | 254/173 R |
| 2,489,832 | 11/1949 | Symonds | 254/173 R |
| 2,652,230 | 9/1953 | Hoyle et al. | 254/173 R |
| 2,820,609 | 1/1958 | Bock et al. | 254/187.4 |

*Primary Examiner*—Robert J. Spar

*Assistant Examiner*—Kenneth Noland

*Attorney, Agent, or Firm*—Seed, Berry, Vernon & Baynham

[57] ABSTRACT

A synergistic safety system is incorporated in a crane driven by a high-speed motor which requires both an energy-absorbing torque-limiting device in the speed reduction unit and a drum emergency holding device. The energy-absorbing torque-limiting device transmits the static and dynamic torque required to rotate or hold the drum against the maximum carried load, but will slip at a pre-determined setting to absorb high-speed rotational energy of the drive train and/or torque of the drive motor in the event a two-blocking, load hang-up, overload, or engagement of the drum emergency holding device occurs. The drum emergency holding device is set automatically when the energy-absorbing torque-limiting device is actuated and/or any drive train component fails, which are detected by one or more sensing sub-systems.

14 Claims, 8 Drawing Figures

SINGLE FAILURE PROOF CRANE

BACKGROUND OF THE INVENTION

1. Field of the Invention

This invention pertains to hoisting cranes, and more particularly, to safety features of hoisting cranes to prevent dropping or damaging the load because of a failure within the hoist system, and to protect the entire system from the forces resulting from load hang-up, or two-blocking.

2. Description of the Prior Art

Many cranes, such as nuclear fuel-handling cranes, require extreme failure-proofing safety measures because the potential consequences of dropping a load, due to failure of one of the components of the crane, may be disastrous. Two occurrences which can lead to failures, result when: (1) the traveling block of the crane reeving system accidentally engages the stationary or head block of the reeving system (known as two-blocking), or (2) the load or traveling block catches or hangs-up on some structural obstruction as the load is being hoisted (known as load hang-up). When either of these situations occurs, the crane and the reeving components become in effect a rigid system. The kinetic energy of the high-speed rotating components and the energy input of the drive motor must then be dissipated by elastic and/or inelastic deformation of the weakest member of the system—frequently leading to its failure. Often the cables are the weakest component of the crane and many times they fail—allowing the load to drop uncontrolled. Even if failure does not occur, the stresses to which the hoist and other crane components have been subjected cannot be determined and thus the remaining factor of safety of the crane is suspect. Additionally, the load itself must be protected from being torn apart during a load hang-up. The forces required to damage the load will vary with its strength, but are generally less than those which can be exerted by the crane's machinery.

In the past, various redundant switches have been placed in the vicinity of the crane reeving system so that as the traveling block approaches the stationary block the switches will de-energize the motor to bring the crane to rest. However, in some cases these switches fail due to improper installation, maintenance or wear. Secondly, these switches do not provide a safeguard against load hang-up. A second technique has been to provide substantial crushable or sacrificial structure between the traveling block and the stationary block. The purpose of this structure is to absorb the kinetic energy of the crane components so that it will be dissipated prior to the formation of a rigid system. Whether used with or without the switches, this technique is extremely costly and still does not prevent over-stressing and failure in the event of a load hangup or overload, during which the motor breakdown torque may be applied.

Clutches have been utilized in construction-crane drive trains to protect against overloads, but have not been utilized in overhead cranes because the clutch, or energy-absorbing torque-limiting device, would make the crane susceptible to loss of control of the load in the event of a mechanical failure of the clutch—an unacceptable risk for cranes used in critical service.

Drum emergency holding devices have been used to hold cable drums in a stationary position, but have not been used to suddenly stop hoists' drive systems, since the impact loading of the sudden stop on the drive train cannot be accurately evaluated. Furthermore, the large amount of rotational kinetic energy of the high-speed hoisting equipment would probably be absorbed in inelastic deformation of the drive train which could lead to failure or subsequent maloperation of the equipment.

Duplicate drive trains have been relied upon in the past to protect critical loads in the event of a single mechanical failure of a drive train component. However, merely duplicating the drive train components penalizes the hoist design in terms of the cost and weight of the extra equipment. Furthermore, the substantial increase in weight of the additional equipment that must be supported by the girders contributes to even more cost. Also, duplicate drive trains are still subject to common-mode failures and thus they do not provide diverse redundancy.

SUMMARY OF THE INVENTION

It is an object of this invention to provide a safety device for uncoupling the prime mover and the high-speed, high-kinetic energy components of a drive train from the load following accidental stopping of the load by an external force, and to protect the load following a discontinuity in the safety device or drive system.

It is another object of this invention to provide means for dissipating kinetic energy following the accidental stoppage of a hoisted load and bring the load automatically to rest rather than to depend on the elasticity of the hoisting ropes and structures.

It is another object of this invention to provide a hoist with diverse- and dual-load paths for safely supporting critical loads following any credible single failure of the drive train.

It is also an object of this invention to provide a hoist which is protected from excessive stresses and the resultant uncertainty in the condition of the hoist following an attempt to lift a load in excess of the crane's rated capacity or other overloading, including a load hang-up or two-blocking.

Basically, these objects are obtained by providing in the high-speed end of the crane drive train a torque-limiting device which will transmit the required running- and static-torques in both directions, but will limit the amount of torque which can be imposed on the system by the drive motor and will dissipate the kinetic energy of the high-speed end of the drive train when the drive train becomes overloaded. Detection of an over-speed running condition of the drum or prime mover, or a discontinuity in the drive train engages the drum emergency holding device to assure that a failure of the torque-limiting device itself can be detected and the drum stopped safely. This torque-limiting, failure detection, and drum holding combination assures protection against most any condition of single failure within the hoisting system. Even more complete failure protection can be achieved by combining this invention with the drive-train-failure detection system disclosed in commonly assigned co-pending application Ser. No. 883,539.

As compared with sacrificial structure for absorbing kinetic energy on impact and redundant gear trains as are commonly used under present practice, the system of this invention provides substantial cost savings and increased reliability, since only one drive train is required for a dual-load path that does not depend upon duplicate equipment for both paths.

The location of the energy-absorbing torque-limiting device in the high-speed end of the drive train is critical. It has been discovered that typically more than 95% of the kinetic energy is contained in the prime mover and the equipment that is rotating at the same speed as the prime mover, i.e., the conventional mechanical and electrical brakes, and the input shaft to speed reduction unit. Preferably, the location for the torque-limiter is between the first input shaft and the second stage idler shaft or more specifically between the first large (bull) gear and the second stage idler shaft. This bull gear has over ⅔ of the kinetic energy that is not associated with the motor and other high-speed components. A substantial part of the remaining energy is in the hoist cable drum, so little additional energy is isolated if the decoupling by the torque-limiter is accomplished in the slower speed shafts of the speed reduction unit. More importantly, since the torque transmitted by the slower speed shafts is significantly greater, the reliability of a torque-limiting device is decreased and may compromise the speed reduction unit's load carrying capacity. Uncoupling at the input to the speed reduction unit would undesirably leave as much as 20% of the total energy to be absorbed by the cables and blocks.

An additional object of the invention is to provide an adjustable energy-absorbing torque-limiting device to prevent damage to loads of varying strengths and weights during a load hang-up. Basically this object is achieved by adjusting externally the torque limit at which the device begins to slip so that hang-up of a light, fragile load will cause the device to slip at a torque considerably less than normally would be required to make a rated capacity lift. One of the most important benefits achieved with the adjustable energy-absorbing torque-limiting device and the associated failure detection components of this invention is the ability to provide, along with redundant reeving, a diverse and redundant crane/load failure protection system at a considerable savings in cost. In fact it had been speculated prior to this invention that such a diverse-failure-proof system was virtually impossible—requiring either costly administrative operating procedures to avoid a crane failure that could lead to damage of critical loads, or a relaxation in safety standards.

The preferred embodiment of the invention is illustrated in FIGS. 1-6 and best describes the principles of the interaction between the energy-absorbing torque-limiting device 97 and a drum emergency holding device 100. The unique feature of this invention provides drum stoppage in a short distance brought about by the combination of the energy-absorbing torque-limiting device in the drive train to isolate the majority of the kinetic energy of the drive train and a drum emergency holding device acting directly on the drum. The drum emergency holding device can be used only because the energy-absorbing torque-limiting device protects the drive train from excessive impact loading when the drum emergency holding device engages. The energy-absorbing torque-limiting device in the drive train can be used only because the drum emergency holding device protects the load from a mechanical failure or abnormal slippage of the torque-limiting device. Thus the two components are uniquely interrelated such that neither can be provided without the other and each enhances the function of the other. This provides the unique synergistic result of having a much safer, less expensive hoisting system which avoids the problems of two-blocking, load hang-up, overload, and load damage.

Figure 2:
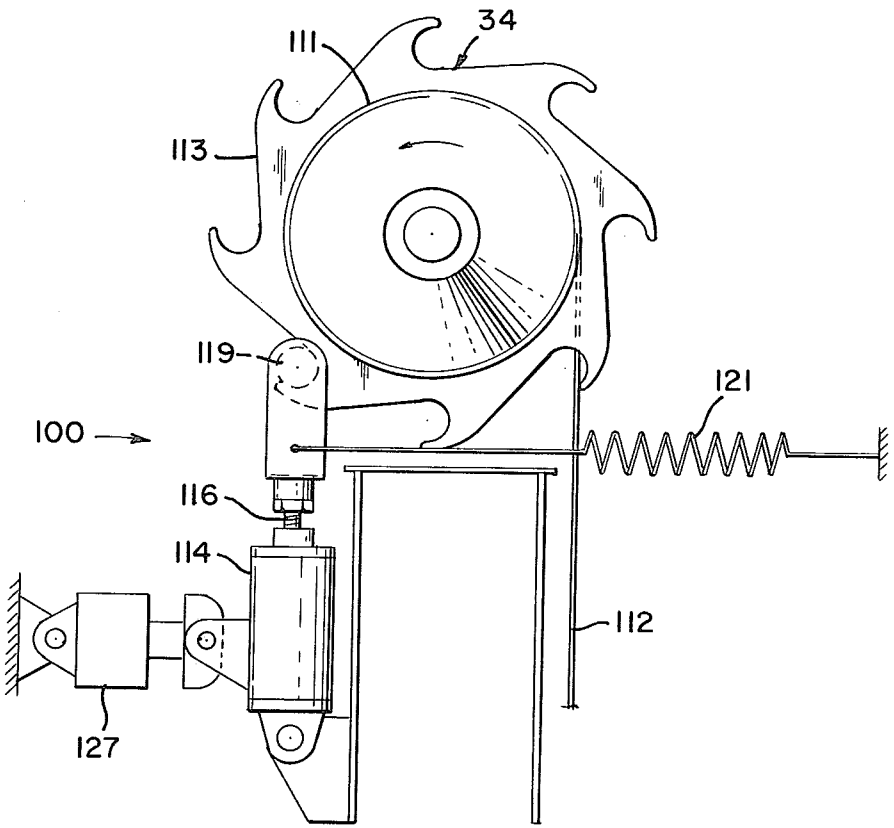
FIG. 2 is a schematic illustration of a portion of the hoisting system shown in FIG. 1.
Figure 3:
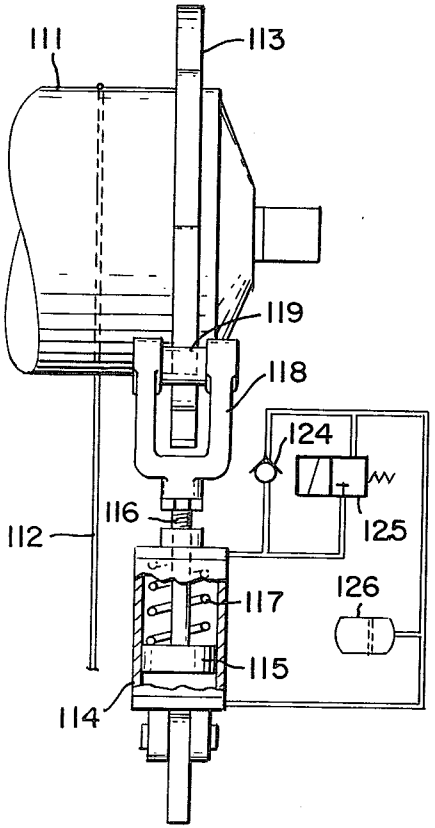
FIG. 3 is a side view of FIG. 2.

In this preferred form of the invention the drum emergency holding device 100 is a positive engaging pin or pawl 119 which is normally held in a retracted position, to the left in FIG. 2, by an energized solenoid 127 and is brought into engagement with the hoist drum flange 34 by a spring 121. The flange is provided with notches 113 which will engage the pin and pull against a piston rod 116 of a cylinder 114. The cylinder brings the load to rest quickly after some malfunction or hazard condition has occurred. It would be hazardous because of the kinetic energy of the system to impose such a stopping force on the drum in the absence of the energy-absorbing torque-limiting device 97.

As a typical example, assume that a hoist with a 4 part line two-blocks while raising a 50,000 lb. load at 7.75 feet per minute. The kinetic energy of the moving load is about 13.0 ft-lb. This small amount of kinetic energy can be safely absorbed by the traveling and stationary blocks as they contact. The kinetic energy of the drive components between the load and the energy-absorbing torque-limiting device is only about 42 ft-lb compared to almost 3000 ft-lb. in the rest of the drive train. The line can be safely stressed to 0.4 of its breaking strength ($0.4 \times 79{,}600$ pounds in this example). Thus the difference between the elongation of the cable resulting from the static load and the elongation corresponding to 0.4 of its breaking strength is available to absorb the kinetic energy of the rotating machinery (in this example only about 300 ft-lb of the kinetic energy can be safely absorbed in the event a two-blocking occurs while a rated capacity lift is being made).

In the preferred form the solenoid 117 is energized to hold the pin to the left so that in the event of an electrical malfunction, which de-energizes the solenoid, the pin is automatically drawn into the drum. The load at which the cylinder 114 resists movement of the drum is easily controlled by a relief valve 125 which couples one side of the piston 115 of the piston rod to an accumulator 126. A return spring 117 will restore the piston rod to its retracted position after the pin has been reset by the solenoid.

The hoist drum 111 is provided with the flange 34 and with a drum gear 133. Cable 112 is wrapped on the drum in a conventional manner. The drum gear is rotated by the drum pinion 122 through gear box 18 which includes the energy-absorbing torque-limiting device 97. The speed reduction unit within the gear case is driven by a high-speed input shaft driven through a coupling 120 by the motor 119 with its brakes 128.

Recognition of a hazardous condition, de-energizing the solenoid 127, and thus setting the stop pin 119 can be accomplished by any number of techniques already discussed. These would include detecting an out-of-synch movement between the input and output halves of the energy-absorbing torque-limiting device, out-of-synch movement between the drum and the motor, some change in commanded-speed or -direction relative to actual-speed or -direction, or a simple overspeed detection device.

For example, assume that the motor in the crane described above starts lowering the load at an excessive speed. If the drum over-speed switch engages pin 119 when the drum rotational velocity corresponds to a load speed of 10 feet per minute the kinetic energy of the load will be about 21.6 ft-lb. and the kinetic energy of the drive train between the load and the energy-absorbing torque-limiting device will be about 71 ft-lb. The positive drum locking device must be able to safely absorb the sum of these two kinetic energies, i.e., 93 ft-lb, to bring the load to rest. Thus if a 75,000 lb retarding force is applied by cylinder 114, pin 119 will displace about 0.015 inches in bringing the load to rest. The retarding force applied can of course vary depending upon the stroke or movement desired of the piston rod 116.

Figure 4:
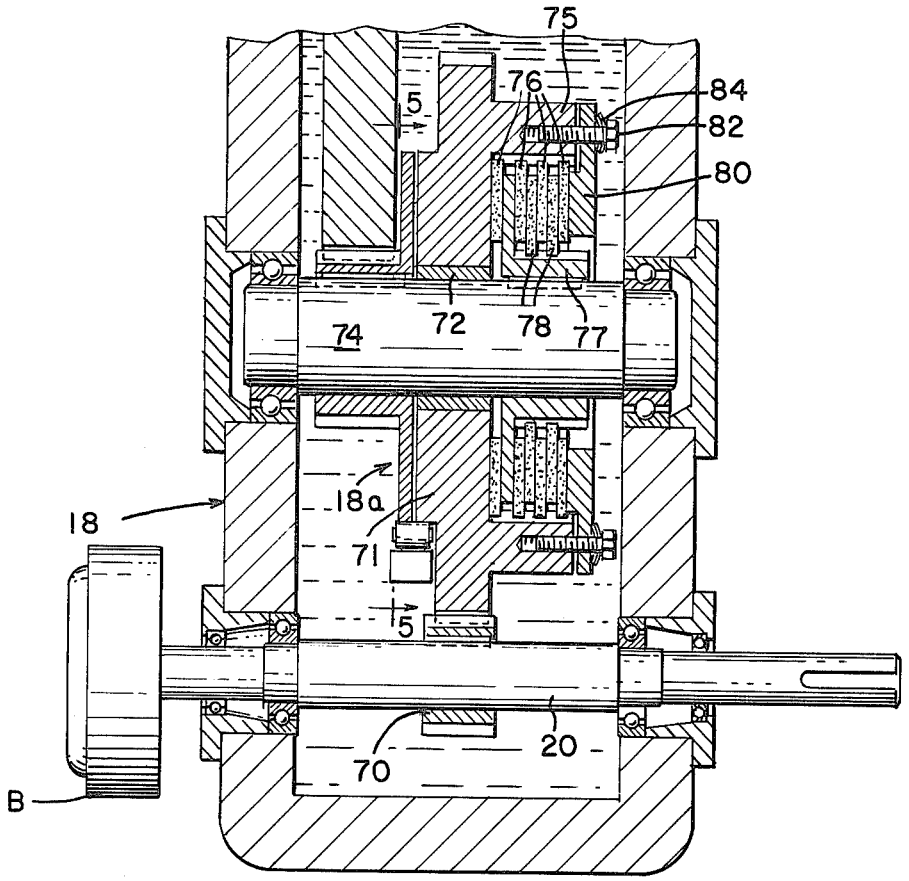
FIG. 4 is a fragmentary section through a gear reduction unit used in the hoisting system of FIG. 1.
Figure 5:
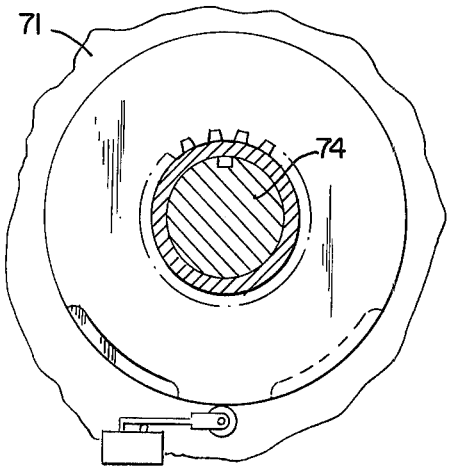
FIG. 5 is a section taken along line 4—4 of FIG. 4.

It is a unique feature of this invention that an energy-absorbing and -decoupling clutch is provided in the high-speed end of the drum's drive train and is uniquely combined with the over-speed detector and drum emergency holding device to provide a synergistic total brake and shock-absorbing hoisting system not heretofore known in the art. The energy-absorption component of this invention is best shown in FIG. 4 which illustrates a fragmentary section through the speed or gear reduction unit 18. The first reduction gears 18*a* are also the high-speed end of the drive train and as described earlier contain most of the kinetic energy of the drive train but must transmit a relatively small percentage of the torque carried by the low-speed shafts in the drive train. Thus by placing the energy-absorbing torque-limiting device in the first speed reduction of the drive train it is possible to transmit the required torque while still having overload protection by slippage to dissipate the high-speed kinetic energy of the drive train upstream of the first speed reduction. For this purpose, the first speed reduction 18*a* is provided with a pinion 70 keyed to the motor shaft 20 which meshes with a bull gear 71. The bull gear is rotably mounted by bearings 72 on a second reduction idler shaft 74. The bull gear is provided with a cylindrical flange 75 having friction plates 76 splined thereon in a conventional manner. Keyed to the shaft 74 is a stationary clutch hub 77 having a plurality of metal separator plates 78 splined to the hub 77 in a conventional manner. The separator plates are positioned between alternate friction plates 76. A pressure plate 80 is secured to the flange 75 by a plurality of circumferentially spaced bolts 82. The bolts are separated from the pressure plate by belleville springs 84 which provide a pre-set spring pressure which clamps the pressure plate 80 toward the gear 71 thus providing a pre-set friction force to transfer the torque between the bull gear 71 and the second reduction idler shaft 74. In practice this setting would be determined by trial and error since hoisting requirements may vary greatly for different hoisting applications. At this location for one example given with a 740:1 total gear reduction ratio it is expected that the friction discs must be able to transfer approximately 5,000 inch-pounds of torque for a 25 ton hoisting load powered by a 15 horsepower motor.

In operation, should a load which is being hoisted hang-up on a structure surrounding the hoist or should the traveling block engage the fixed block, and thus in either case provide an overload, the motor 119 will normally be de-energized either by conventional overload detecting switches, or excessive deviation between the drum and the motor encoder outputs as described in said co-pending patent application, or by redundant electrical safety switches in the case of the traveling block approaching the stationary block. The positive engaging pin will be brought into engagement by de-energizing the solenoid 127, so that the load will be held if the energy-absorbing torque-limiting device continues to slip after the kinetic energy has been dissipated. The overload before the motor is completely at rest will be absorbed by the friction plates and separator plates slipping relative to one another generating heat. The heat will normally be of only a short time duration and can be easily carried away by the oil circulating within the speed reduction unit 18 since the entire energy absorption mechanism will be immersed in the gear lubricating oil.

Figure 6:
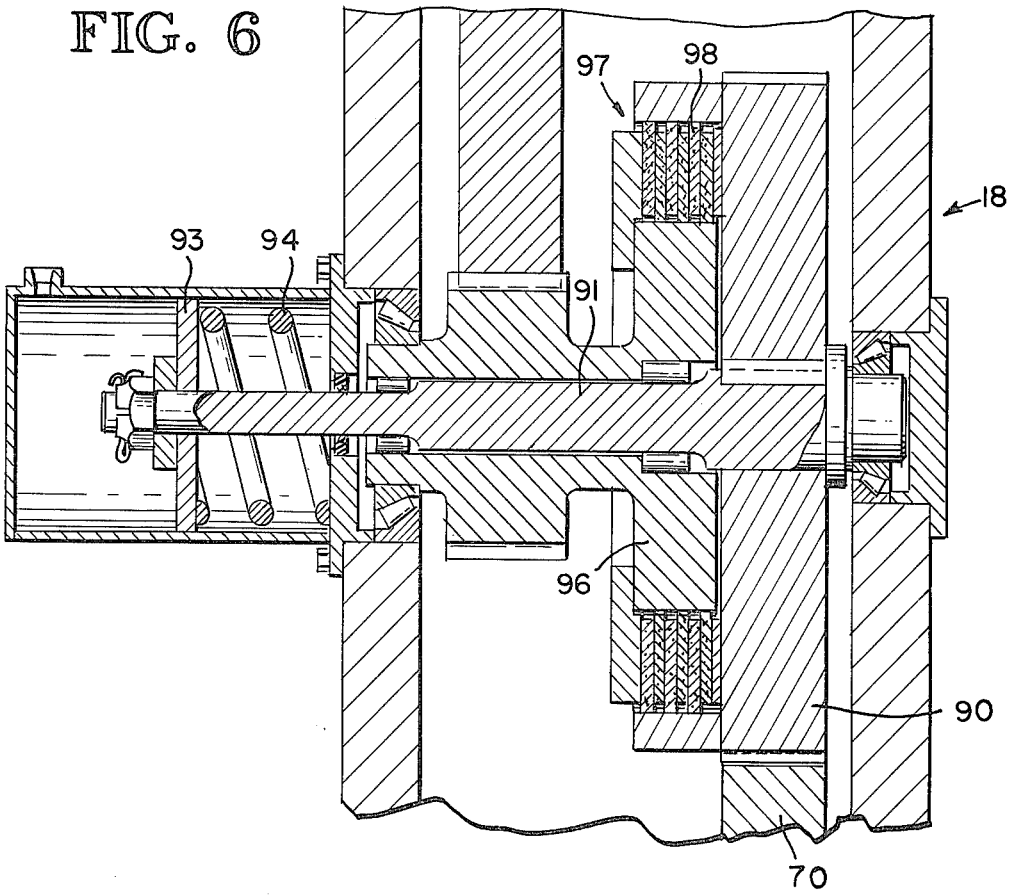
FIG. 6 is a fragmentary section like FIG. 4 of another embodiment of the invention.
Figure 1:
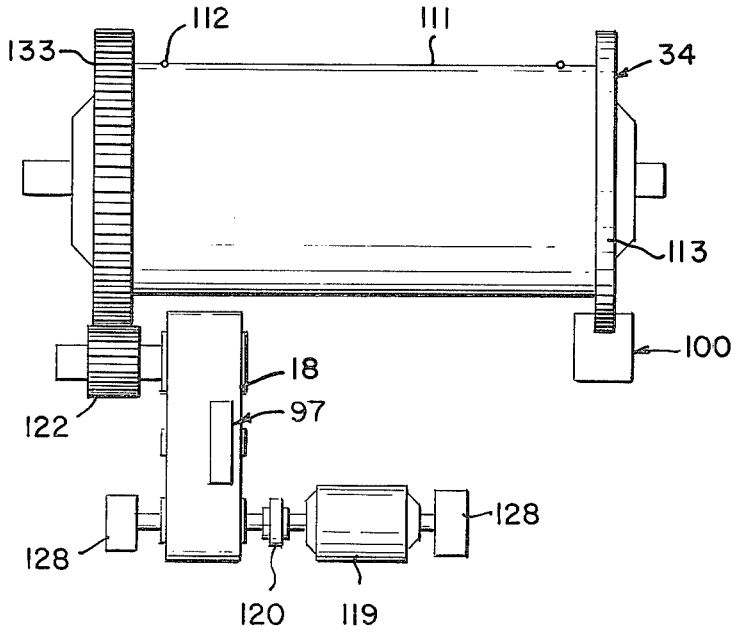
FIG. 1 is a schematic plan view of the preferred embodiment of a hoisting system embodying the principles of the invention.

As shown in FIG. 6 another level of safety is achieved by providing external adjustment of the energy-absorbing torque-limiting device. In this embodiment the speed reduction unit 18 is provided with a first-reduction bull gear 90 keyed to an axially shiftable support shaft 91. Shifting of the shaft is provided by an air cylinder and piston 93 which is operated against a compression spring 94 by operator controlled air from 0–100 psi, for example. The bull or input gear is releasably coupled to a clutch hub 96 by a conventional clutch pack 97 of the type which transmits torque between the gear 90 and clutch hub 96 by compressing the clutch discs and spacers 98 within the clutch pack. The clutch hub is integral with an output pinion to the second reduction. In operation the operator determines the torque at which a critical load will fail. If it is greater than the torque setting that is required to provide the necessary safety factor for the crane components, the torque is set the same as for preventing a failure of the crane system. If the torque to protect the load is less, then the lower setting is applied by admitting air pressure against the piston 93 to offset part of the force of spring 94 and thus cause the clutch to slip at a lower torque.

Figure 7:
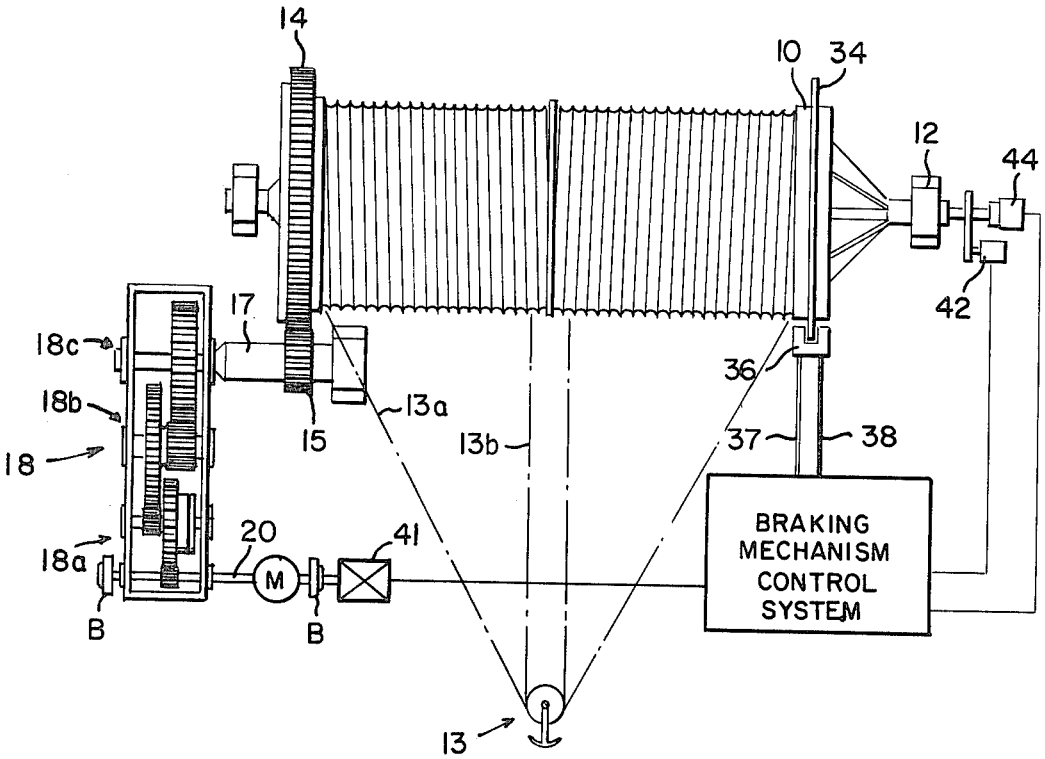
FIG. 7 is a schematic plan view of an alternate embodiment of a hoisting system embodying the principles of the invention.
Figure 8:
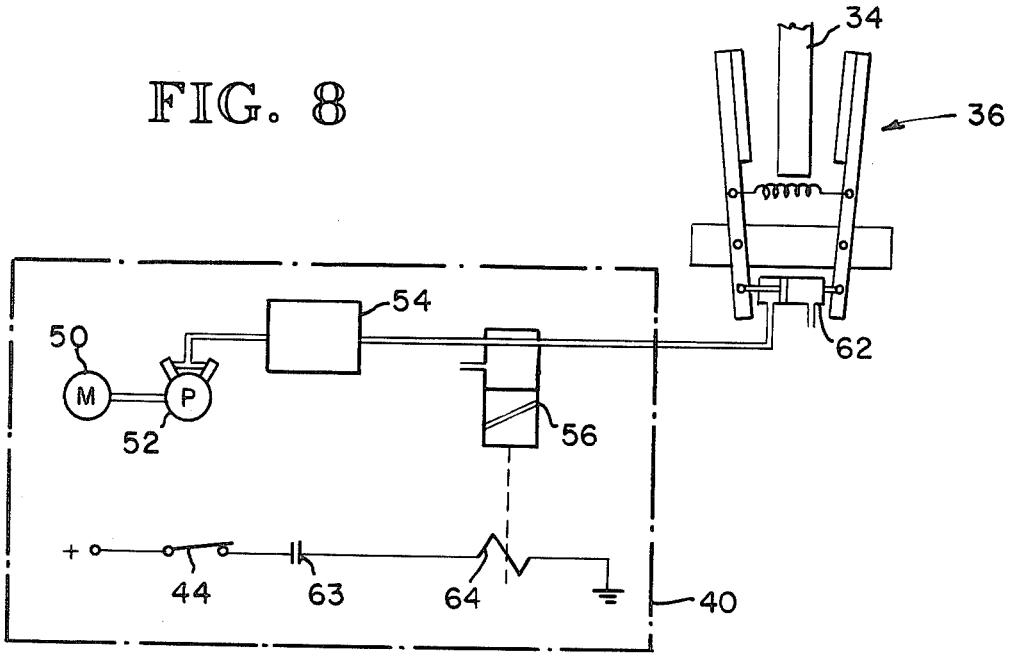
FIG. 8 is a schematic illustration of a portion of the hoisting system shown in FIG. 7.

FIG. 7 illustrates an alternate embodiment of the invention which utilizes the Cable Drum Safety Brake System disclosed in commonly assigned co-pending application Ser. No. 883,539. In this alternate embodiment a hoist drum 10 is mounted for rotational movement in bearings 12 and carries a hoist cable 13. The cable is shown as having dual reeving 13*a* and 13*b* for redundant safety, if desired. The drum is provided with a drum gear 14 that is powered by a pinion 15. The pinion is keyed on an output shaft 17. In one typical example, the speed reduction between the pinion 15 and the gear drum 14 is 6.1:1. A gear reduction unit 18 is provided with an additional three stages of speed reduction which include a first stage 18*a*, for example, having a reduction of 6.2:1; a second stage 18*b* having, for example, a reduction of 4.9:1; and a third stage reduction 18*c* having, for example, a reduction of 4.0:1. The exact reductions and the number of reductions is, of course, subject to considerable variation depending upon the requirements of the particular installation. An input shaft 20 is powered by a motor M which includes conventional electric and mechanical brakes.

The hoist system has an additional braking system comprising a disc 34 attached to the drum 10, a caliper brake 36 opened by pneumatic lines 37 and 38. The pneumatic lines are coupled to a braking mechanism control system 40 which releases the air pressure input to the lines 37 and 38 to actuate the caliper brake 36 when the number of pulses from a drive motor encoder 41 deviate by a sufficient amount from the number of the pulses produced by a cable drum encoder 42 which measures the rotation of the drum. A conventional overspeed switch 44 will actuate the braking mechanism when the drum is rotating in excess of some predetermined speed.

The brake 36 is pneumatically powered from a motor 50 which drives a conventional compressor 52. The compressor supplies pressurized air to a tank 54. A conventional solenoid valve 56 directs the pressurized air to a cylinder 62 for releasing the caliper brake 32. The solenoid valve is energized by a control circuit which includes the over-speed switch 44, normally open relay contacts 63 and a solenoid coil 64. The contacts 63 are kept open when the rotation of the drum 10 and the motor M are in-synch with respect to one another. Thus the solenoid can be de-energized by a deviation from the preset compared values or by an over-speed condition or by total electrical failure of the system.

The details of the foregoing hoist system apparatus are more fully disclosed in the commonly assigned patent application entitled "Cable Drum Safety Brake" Ser. No. 883,539 filed herewith which description is hereby incorporated herein by specific reference therto. However, application of the "Cable Drum Safety Brake" can be extended by utilizing the synergistic relationship established by this invention. Because of adverse environmental conditions, such as contaminates, some applications require the drum caliper brake to have excess braking capacity over that which would be required to stop or hold the load under normal operating conditions. In these applications, the energy-absorbing torque-limiting device is required to protect the drive train from impact loading following engagement of the caliper brakes for the same reasons that use of the drum emergency holding device depended upon use of the energy-absorbing torque-limiting device. The caliper brakes serve the same function as the drum emergency holding device in protecting the load from undesired slippage of the energy-absorbing torque-limiting device.

As is apparent the total combination of energy-absorption, failure detection, and drum holding thus provides a relatively inexpensive and considerably safer total-braking and energy-absorption system than was heretofore possible in the prior art. With the adjustable setting to uncouple the drive train, the load also is protected from over-loads applied to it. While the preferred embodiments of the invention have been illustrated and described it should be understood that variations will be apparent to one skilled in the art without departing from the principles expressed herein. For example, the adjustability of the decoupling torque can be provided mechanically, electrically by other means within the skill of the art. Accordingly, the invention is not to be limited to the specific embodiments illustrated in the drawing.

I claim:

1. A safety system for a hoisting crane having a drum, a cable on the drum, a high-speed motor, a load drive train coupling the motor to the drum, said load drive train including a speed reduction unit, the improvement comprising:

emergency holding means for stopping instantaneously rotation of the drum, said holding means being located outside of the load drive train so that the drum will not rotate where a failure occurs in any portion of the load drive train, said speed reduction unit having at least higher-speed and lower-speed reducing stages, passive energy-absorption torque-limting means located in and comprising a part of the higher-speed stage for allowing continued movement of the higher-speed stage and motor when the drum is stopped by the holding means and for dissipating the kinetic energy of the higher-speed stage and motor until the motor and higher-speed stage are brought to rest, means for detecting a failure of said load drive train, means for engaging the holding means in response to said detecting means when a failure condition is detected.

2. The system of claim 1, said passive energy-absorption torque-limiting means including a high-speed first stage input shaft, a second stage idler shaft, friction means operatively connecting said first and second stage shafts for transferring driving torque during static and dynamic conditions but allowing slip during overload conditions.

3. The system of claim 2, said friction means including a clutch hub fixed to said second stage idler shaft, a plurality of separator plates splined to said hub, a bull gear rotably mounted on said second stage idler shaft, a plurality of friction plates splined to said bull gear and interdigitating with said separator plates, and pressure plate means for squeezing the friction plates and separator plates together with a pre-set force to transfer driving torque between the shafts.

4. The system of claim 2, said emergency condition detection means and said emergency holding means including an emergency locking member directly coupled to said drum to prevent rotation at least in the direction of lowering the load.

5. The system of claim 1, said speed reduction unit having an oil bath, said energy-absorption means being immersed within said oil bath for dissipating heat during an overload.

6. The system of claim 1 said passive energy absorption torque-limiting means including means to externally vary the torque at which the drive is uncoupled and the kinetic energy dissipated so as to protect loads which would fail at less than the full load rating of the crane.

7. The system of claim 1, said holding means being passive and operating only in an emergency hazard condition.

8. The system of claim 1, wherein said detection means includes drum detecting means which senses overspeed of the drum.

9. A safety system for a hoisting crane having a drum, a cable on the drum, a high-speed motor, a load drive train coupling the motor to the drum, said load drive train including a speed reduction unit, the improvement comprising:

passive auxiliary emergency holding means for rapidly stopping rotation of the drum, said holding means being operative in an emergency hazard condition, said speed reduction unit having at least higher-speed and lower-speed stages, passive energy-absorption torque-limiting means located in and comprising a part of said higher-speed stage for uncoupling and allowing continued movement of the higher-speed stage and motor for dissipating the kinetic energy of the higher-speed stage and motor when the drum is stopped, means for detecting a failure of said load drive train, and means for engaging the holding means in response to said detecting means when an emergency condition is detected.

10. The apparatus of claim 9, said speed reduction unit containing an oil bath, said passive energy-absorption torque-limiting means including friction torque transfer means immersed in said oil bath for dissipating heat when said friction torque transfer means is loaded to slippage.

11. The apparatus of claim 9, said speed reduction unit including a high-speed stage input shaft, a second stage idler shaft, a large diameter driven gear rotatably mounted on said second stage idler shaft, a pinion gear fixed on said high-speed stage input shaft, said passive energy-absorption torque-limiting means including first friction members splined to said driven gear, second friction members splined to said second stage idler shaft, and pressure plate means squeezing the first and second friction members together for frictionally driving the second stage idler shaft from said pinion gear.

12. The system of claim 9, including means to externally vary the torque at which the drive is uncoupled and the kinetic energy is dissipated to protect loads which would fail at less than that of the full load rating of the crane.

13. The system of claim 12, said torque varying means including means for axially shifting one component of the drive train for reducing the friction pressure on the passive energy-absorption torque-limiting means.

14. The system of claim 9, wherein said detection means includes drum detecting means which senses overspeed of the drum.

* * * * *